US006168870B1

(12) United States Patent
Wall

(10) Patent No.: US 6,168,870 B1
(45) Date of Patent: Jan. 2, 2001

(54) POLYMER PLASTIC PLUG IMPREGNATED WITH WOOD PRESERVATIVE AND METHOD FOR MAKING THE SAME

(75) Inventor: Wesley James Wall, Spruce Grove (CA)

(73) Assignee: Genics Inc., Spruce Grove (CA)

( * ) Notice: Under 35 U.S.C. 154(b), the term of this patent shall be extended for 0 days.

(21) Appl. No.: 09/138,864

(22) Filed: Aug. 24, 1998

(30) Foreign Application Priority Data

Jun. 10, 1998 (CA) ..... 2240226

(51) Int. Cl.[7] ..... B32B 23/08

(52) U.S. Cl. ..... 428/479.3; 428/479.6; 428/535; 428/536; 428/537.1; 215/356

(58) Field of Search ..... 428/535, 536, 428/479.3, 537.1, 473.6; 215/356

(56) References Cited

U.S. PATENT DOCUMENTS 5,114,032 * 5/1992 Laidlaw ..... 215/350

OTHER PUBLICATIONS

Removable Re–usable Replugs, W.S. Laidlaw Products Ltds., product brochure, 2 pages, Apr. 1992.

Engineering Plastic Products, Polymer Corporation Product Brochure, 30 pages, 1992. (No Month).

* cited by examiner

*Primary Examiner*—Leszek Kiliman
(74) *Attorney, Agent, or Firm*—Christensen O'Connor Johnson Kindness PLLC

(57) ABSTRACT

A method of impregnating a polymer plastic plug with wood preservative. A first step involves dehydrating a polymer plastic plug to reduce its naturally occurring moisture content. A second step involves introducing liquid wood preservative into the polymer plastic plug while the polymer plastic plug is in a dehydrated state by immersing it in the liquid wood preservative and boiling the liquid wood preservative at temperatures that are less than that required to turn the polymer plastic plug into a molten state. In accordance with the teachings of this method liquid wood preservative is absorbed into the dehydrated polymer plastic plug in place of the naturally occurring moisture content.

4 Claims, 1 Drawing Sheet

POLYMER PLASTIC PLUG IMPREGNATED WITH WOOD PRESERVATIVE AND METHOD FOR MAKING THE SAME

FIELD OF THE INVENTION

The present invention relates to a preservative-impregnated, polymer plastic plug for sealing preservative chemicals in wood, and method of making the same.

BACKGROUND OF THE INVENTION

Preservative chemicals are placed into wood structures, such as wood poles, posts and pilings, by drilling a hole. After insertion of the preservative chemicals, the hole is sealed by means of a plug. If this plug is contaminated from dust, dirt, water or airborne spores during field use, it can serve as an initial inoculation for decay onset in the wood structure.

When wood plugs are used, an industry practise has been adopted of dip treating the plugs with a 2% copper napthenate preservative solution. This solution protects against the accidental transfer of spores by the plug during field use.

U.S. Pat. No. 5,114,032 discloses a reusable polymer plastic plug for sealing preservative in wood. The plug has threads that allow the plug to be inserted without rotation by hammering, but requires rotation for extraction from the hole. One inherent disadvantage of the reusable plastic plug is that there is no manner of introducing wood preservative into the plastic resin out of which the plug is made. Polymer plastic plugs cannot be dip treated in the same manner as wood plugs are presently treated.

SUMMARY OF THE INVENTION

What is required is a method of making a polymer plastic plug impregnated with wood preservative and a polymer plastic plug made in accordance with the method.

According to one aspect of the present invention there is provided a method of impregnating a polymer plastic plug with wood preservative. A first step involves dehydrating a polymer plastic plug to reduce its naturally occurring moisture content. A second step involves introducing liquid wood preservative into the polymer plastic plug while the polymer plastic plug is in a dehydrated state by immersing it in the liquid wood preservative and boiling the liquid wood preservative at temperatures that are less than that required to turn the polymer plastic plug into a molten state. In accordance with the teachings of this method liquid wood preservative is absorbed into the dehydrated polymer plastic plug in place of the naturally occurring moisture content.

All polymer plastic resins have some naturally occurring moisture content. The present method takes advantage of this fact, by substituting liquid wood preservative for the naturally occurring moisture content.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
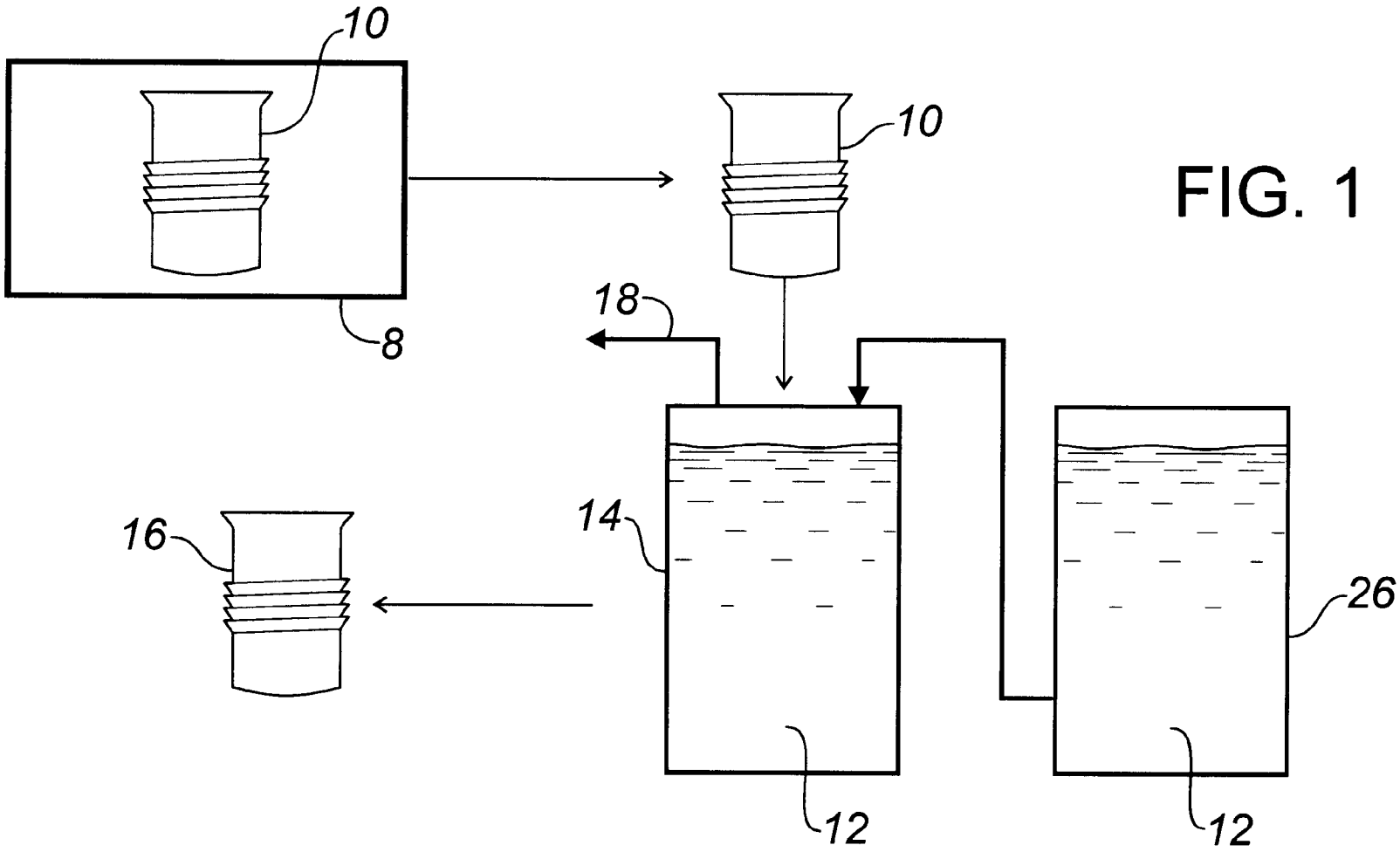
FIG. 1 is a flow diagram illustrating the steps of a preferred method.

The preferred methods of impregnating a polymer plastic plug with wood preservative will now be described with reference to FIG. 1.

Referring to FIG. 1, the preferred method of impregnating a polymer plastic plug involves replacing the naturally occurring moisture content of the polymer plastic from which the plug is made with liquid wood preservative. A first step involves dehydrating an untreated polymer plastic plug 10 to reduce its naturally occurring moisture content. This is accomplished by placing untreated polymer plastic plug 10 into an oven. A second step is to immerse untreated polymer plastic plug 10 in a solution of wood preservative 12 fed from a supply vessel 26. The immersion is performed at a temperature at which the natural moisture content of the polymer plastic continues to be removed as steam 18 and replaced by liquid wood preservative 12. The vessel 14 in which untreated polymer plastic plug 10 is immersed in liquid wood preservative 12 is maintained at a temperature at which the treatment is performed. The temperature must be below the softening point of the polymer plastic to avoid deformation of the plug, but sufficiently high to remove the naturally occurring moisture from the plug. A wood preservative impregnated plug 16 is then removed from the remaining liquid wood preservative. The process may be adapted to be performed continuously or by sequential treatment of batches of plugs.

Examples will now be provided to assist in the successful application of the teachings of the method. It will be understood that the temperatures and residence time must be varied to suit the type of polymer plastic material out of which untreated polymer plastic plug 10 is made.

EXAMPLE 1

Nylon polymers generally have a naturally occurring moisture content approaching 7% and a melting point of around 500 degree Fahrenheit. When treating a plug made from such nylon polymers the following steps are taken:

Dehydration is accomplished by placing plugs 10 into oven 8 at a temperature of 250 degrees Fahrenheit. This is above the 212 degree Fahrenheit boiling point of water, but well below the melting point of the nylon polymer. During this step moisture is driven from plugs 10. A residence time of 10 to 15 minutes has generally been found to be sufficient.

Wood preservative is introduced into plugs 10 by immersing plugs 10 in wood preservative 12 and boiling plugs 10 at a temperature of approximately 350 degrees Fahrenheit. This is above the 212 degree Fahrenheit boiling point of water, but well below the melting point of the nylon polymer. A residence time of 10 to 15 minutes has generally been found to be sufficient.

EXAMPLE 2

Polyethylene polymers generally have a naturally occurring moisture content approaching 2% and a melting point of around 335–490 degrees Fahrenheit. When treating a plug made from such polymers the following steps are taken:

Dehydration is accomplished by placing plugs 10 into oven 8 at a temperature of 250 degrees Fahrenheit. This is above the 212 degree Fahrenheit boiling point of water, but well below the melting point of the polyethylene polymer. During this step moisture is driven from plugs 10. A residence time of 10 to 15 minutes has generally been found to be sufficient.

Wood preservative is introduced into plugs 10 by immersing plugs 10 in wood preservative 12 and boiling plugs 10 at a temperature of approximately 250 degrees Fahrenheit. This is above the 212 degree Fahrenheit boiling point of water, but well below the melting point of the polyethylene polymer. A residence time of 10 to 15 minutes has generally been found to be sufficient.

The materials that one selects to make polymer plastic plug 10 from are important. It is preferable to select a polymer material with a high naturally occurring moisture content. It will be appreciated by one skilled in the art that a nylon plug with a 7% naturally occurring moisture content can be impregnated with a higher percentage of wood preservative than can a polyethylene plug having only a 2% naturally occurring moisture content. It will also be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of impregnating a polymer plastic plug with wood preservative, comprising the steps of:

firstly, dehydrating a polymer plastic plug to reduce its naturally occurring moisture content;

secondly, introducing liquid wood preservative into the polymer plastic plug while the polymer plastic plug is in a dehydrated state, such that the liquid wood preservative is absorbed into the dehydrated polymer plastic plug in place of the naturally occurring moisture content.

2. The method as defined in claim 1, liquid wood preservative being introduced into the polymer plastic plug by immersing the polymer plastic plug in the liquid wood preservative and boiling the liquid wood preservative at temperatures that are less than that required to turn the polymer plastic plug into a molten state.

3. A polymer plastic plug for installation in a wood structure, comprising:

a polymer plastic body impregnated prior to installation with a wood preservative chemical.

4. A method of preparing a polymer plastic plug, comprising:

impregnating a polymer plastic plug with a wood preservative chemical; and then installing the polymer plastic plug impregnated with wood preservative chemical into a wood structure.

* * * * *